United States Patent [19]

Bierk

[11] Patent Number: 4,864,736

[45] Date of Patent: Sep. 12, 1989

[54] THONG SANDAL WITH DURABLE TOE TAB FOR USE AS PROMOTIONAL ITEM OR THE LIKE

[75] Inventor: Nancy L. Bierk, St. Louis, Mo.

[73] Assignee: Ad Impressions, Inc., St. Louis, Mo.

[21] Appl. No.: 199,625

[22] Filed: May 27, 1988

[51] Int. Cl.[4] ..... A43B 3/12; A43B 7/26; A43B 23/24

[52] U.S. Cl. ..... 36/11.5; 36/94; 36/137; 2/245; 40/636

[58] Field of Search ..... 36/11.5, 94, 136, 137; 12/142 S; 2/245; 128/81 R; 40/636

[56] References Cited

U.S. PATENT DOCUMENTS

| | | | |
|---|---|---|---|
| 1,554,883 | 9/1925 | Sahlin | 36/94 X |
| 2,042,760 | 6/1936 | Bass | 40/636 |
| 2,506,308 | 5/1950 | Maynier | 36/94 X |
| 2,928,191 | 3/1960 | Meltzer | 36/11.5 X |
| 3,404,469 | 10/1968 | Prenovitz | 36/43 |
| 4,030,212 | 6/1977 | Ito | 36/11.5 |
| 4,712,319 | 12/1987 | Goria | 36/137 |

FOREIGN PATENT DOCUMENTS

| | | | |
|---|---|---|---|
| 794569 | 12/1935 | France | 36/11.5 |
| 1225792 | 2/1960 | France | 36/11.5 |
| 2569893 | 3/1986 | France | 40/636 |

*Primary Examiner*—James Kee Chi
*Attorney, Agent, or Firm*—Grace J. Fishel

[57] ABSTRACT

A thong sandal having a sole fastened to the foot of a wearer by means of an instep strap and a toe tab connected to the sole and latched in the instep strap. The sole and instep strap are made from a flat sheet of material which is flexible and provides a comfortable support when walking of a size and shape to fit under the wearer's foot. The instep strap is partially cut away from the sole around the hee but remains attached to the sole on opposite sides of the instep. It is adapted to fold upward and forward and to latch on the toe tab. The toe tab is formed of a durable material which does not break during normal wear and has a protuberance at its free end distal its attachment to the sole for use as a display surface or it latches to the sole at the toe end such that the sandle folds substantially flat or both. The display surface can be customized to the customer's specifications and the protuberance is advantangeously attached to the stem of the toe tab on what is otherwise a stock sandal.

7 Claims, 2 Drawing Sheets

THONG SANDAL WITH DURABLE TOE TAB FOR USE AS PROMOTIONAL ITEM OR THE LIKE

BACKGROUND OF THE INVENTION

Items such as key chains, coffee cups, ball point pens and the like are frequently imprinted with an advertising message and given away to promote goodwill. They have been so much used, however, that many customers are not particularly pleased to get another one.

For the right kind of business, inexpensive thongs sandals such as the one-piece thongs described in U.S. Pat. No. 4,030,212 to Ito are appropriate and are more attention getting than the conventional items discussed above. With the Ito construction, however, the advertising message is imprinted on the insole and out of view when the thong is worn and the strap between the toes is weak because it is cut of the same soft material as the sole.

In view of the above, there is a need for an inexpensive thong sandal which is constructed such that the strap between the toes is durable and the advertising message stays in view. It is therefore an object of the present invention to provide such a sandal. Other objects and features of the invention will be in part apparent and in part pointed out hereinafter.

The invention accordingly comprises the constructions hereinafter described and their equivalents, the scope of the invention being indicated in the following claims.

SUMMARY OF THE INVENTION

The present invention is ideally suited for use as a promotional item which can be packed relatively flat and relates to a class of shoes consisting essentially of a sole having heel, toe and instep portions fastened to the foot by means of an instep strap attached to the sole and a toe tab interconnecting the sole and the instep strap. The sole and instep strap of the sandal are formed from a flat sheet of material such as foamed plastic and the instep strap is partially cut away from the sole around the heel but remains attached on opposite sides of the instep. In use, the instep strap is folded upward and forward and latched on the toe tab which is formed of a durable material. The free end of the toe tab is enlarged beyond that necessary to latch in the instep strap and provides a visible surface or protuberance above the instep strap upon which advertisements or decoration may be applied or it latches at the toe end such that the sandal folds substantially flat or both.

In a preferred form, the enlarged free end of the toe tab is detachable such that the sandals can be easily customized to the purchaser's requirements, e. g. trademark, logo or the like, by changing only this part. This reduces manufacturing costs as the remainder of the sandal can be mass produced as a stock item.

BRIEF DESCRIPTION OF THE DRAWINGS

In the accompanying drawings, in which several of various possible embodiments of the invention are illustrated, corresponding reference characters refer to corresponding parts throughout the several views of the drawings and in which.

DETAILED DESCRIPTION OF THE INVENTION

Figure 1:
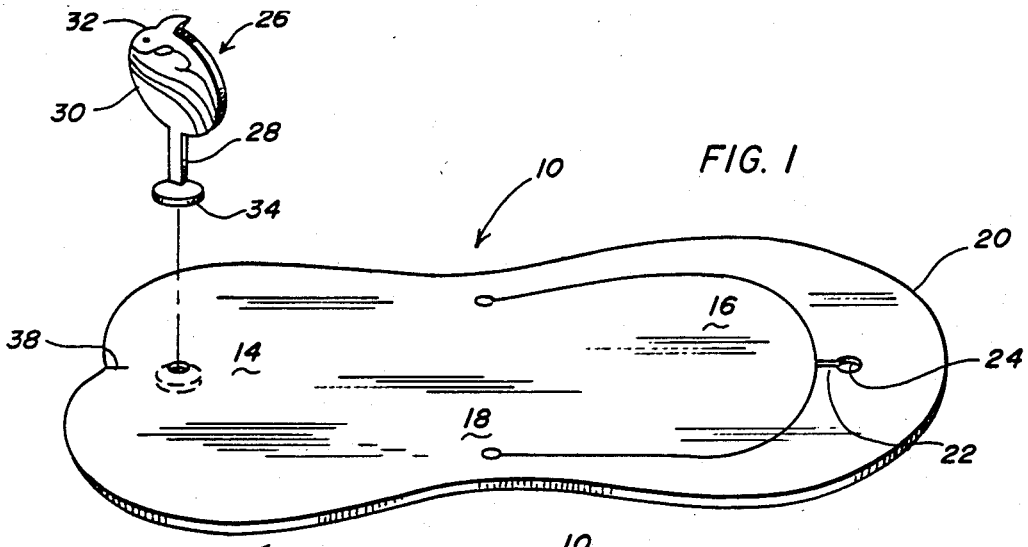
FIG. 1 is a perspective view of a thong sandal before a durable toe tab with enlarged top in accordance with the present invention is installed.

Referring to the drawings more particularly by reference character, a thong sandal 10 having a sole 12 with toe, heel and instep portions 14, 16 and 18, respectively, and an instep strap 20 is cut from a flat blank as shown in FIG. 1. The toe and heel portions and intermediate instep portion are generally disposed to conform to the natural curvature of a foot, to a right foot as shown in FIGS. 1–4.

The blank from which sole 12 and instep 20 are cut can be any flat material which is flexible and which provides a comfortable support when walking such as leather, cloth, plastic and so forth. Suitable materials include foamed plastics and ethylene-vinyl acetate copolymer (EVA) is especially preferred because of its softness and elasticity. EVA can be extruded into a flat sheet and the closed cell formation of the foamed material resists water penetration. Two sheets, preferably in contrasting colors and the lower being more dense than the upper, are preferably joined in a heated press while a tread or decorative pattern is embossed on the bottom of the lower layer. The surface of the upper layer has a slip-resistant leather like feel and the lower layer gives the sandal more durability than would otherwise be possible. Other polyolefins or similar materials such as polyvinyl chloride may also be used in single or multiple layers. The sheet material should be thick enough to protect the wearer's foot while being sufficiently bendable to avoid excessive slapping against the wearer's heel in walking.

Instep strap 20 is a curved member partially cut away from sole 12 around heel 16 but remains attached to sole 12 on opposite sides of instep 18. Instep strap 20 is wider near its midpoint such that it is not unduly weakened by a slot 22 which is provided on the inside of the curve and terminates in a keyhole 24. Slot 22 is generally parallel to the long axis of sole 12 and is for use as more particularly described hereinafter.

A toe tab 26 is attached to sole 12 in the region between the first and second toes of the wearer's foot and includes a stem 28 which passes therebetween. As shown in the drawings, when the free end of toe tab 26 is greatly enlarged beyond that necessary to latch in keyhole 24 of instep strap 20, it provides a protuberance or visible surface 30 on top of the wearer's toe upon which advertisements or decoration, such as porpoise 32, may be applied.

Figure 2:
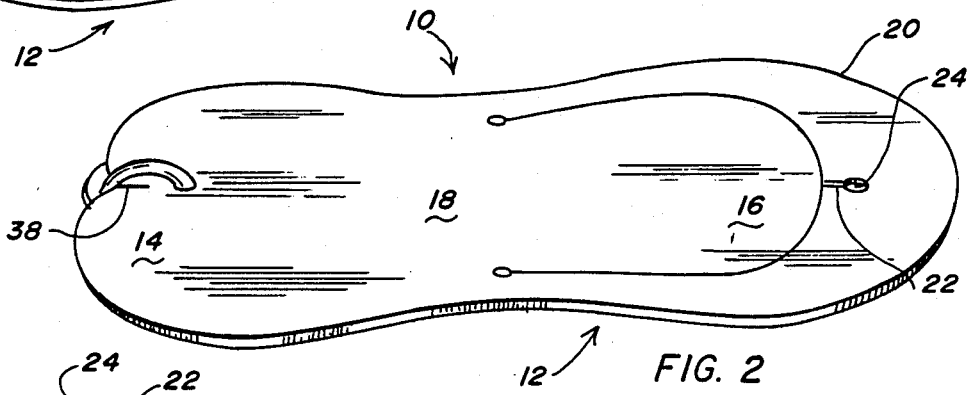
FIG. 2 is a perspective view of the thong shown in FIG. 1 with the toe tab latched generally flat against the sole for storage or shipment.
Figure 3:
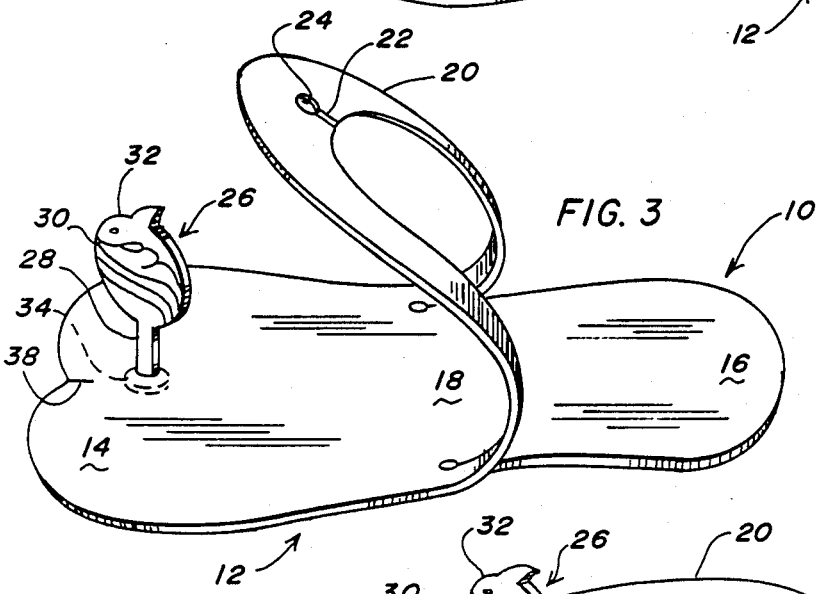
FIG. 3 is a perspective view of the thong shown in FIGS. 1–2 with the toe tab installed and showing an instep strap in the process of being bent upward and forward over the instep of the shoe.
Figure 4:
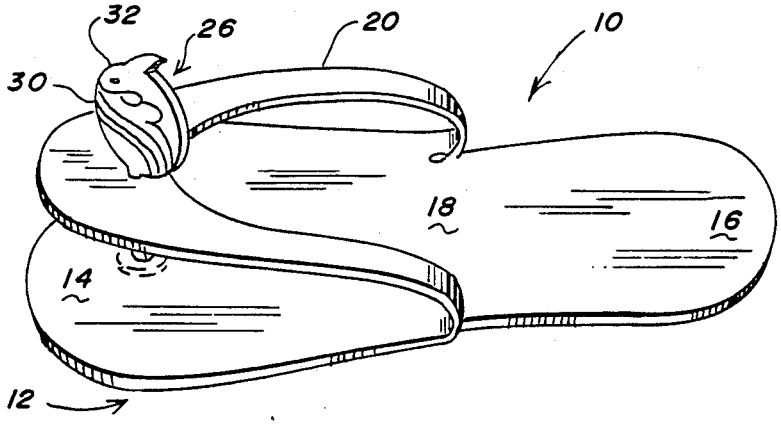
FIG. 4 is a perspective view of the thong shown in FIGS. 1–3 set up ready to wear with the toe tab latched in the instep strap.

Toe tab 26 is formed of a tough material which will not break under normal use. If sole 12 and instep strap 20 are cut from a foamed plastic material, toe tab 26 can be made of unfoamed or more dense plastic of the same or different kind. As shown in the drawings, stem 28 is attached to sole 12 by means of a flange 34 which is received in a recess 36 provided in the underside of sole 12. Other possible means of attachment will occur to those skilled in the art and it should be understood that the particular means shown is for illustration, as it is only important that toe tab 26 not pull out of sole 12 under normal circumstances. As shown in FIG. 2, a slot 38 is provided in the forward end of toe 14 for latching toe tab 26 generally flat against sole 12 for shipment or storage.

For economy of manufacturing, it is preferred that protuberance 30 be attached to stem 28 after the shoe has been formed as the balance of the shoe can be manufactured as a stock item and protuberance 30 added in such shape with such decoration or advertising applied to meet the requirements of the customer. Of course an additional message or decoration can be imprinted on the inner or out portions of the sole but this has the above-mentioned disadvantage that it is out of view when the sandal is worn.

Figure 5:
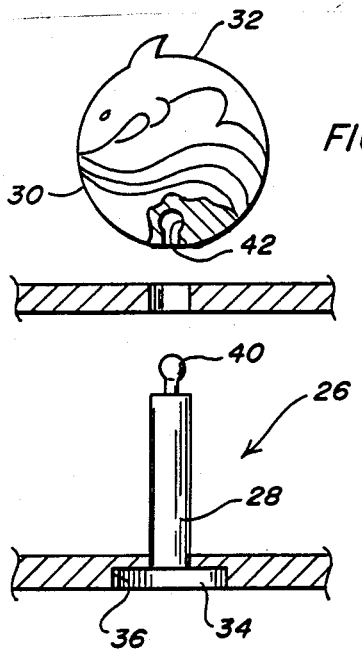
FIG. 5 shows a means for attaching the top of the toe tab to the stem of the toe tab.
Figure 6:
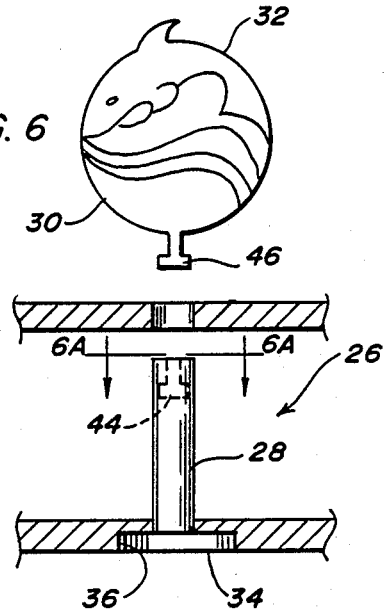
FIG. 6 shows another means for attaching the top of the toe tab.
Figure 6A:
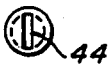
FIG. 6A is a view taken along line 6A—6A in FIG. 6.
Figure 7:
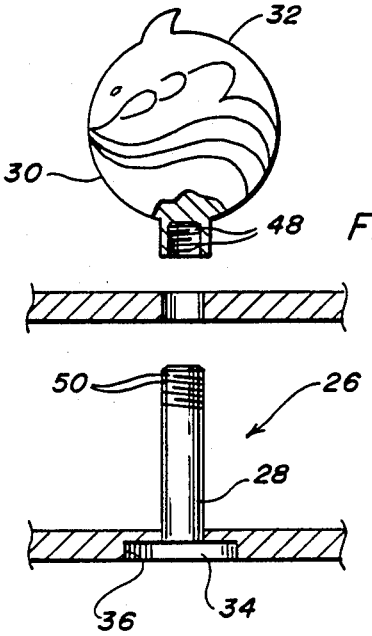
FIG. 7 shows still another means for attaching the top of the toe tab.
Figure 8:
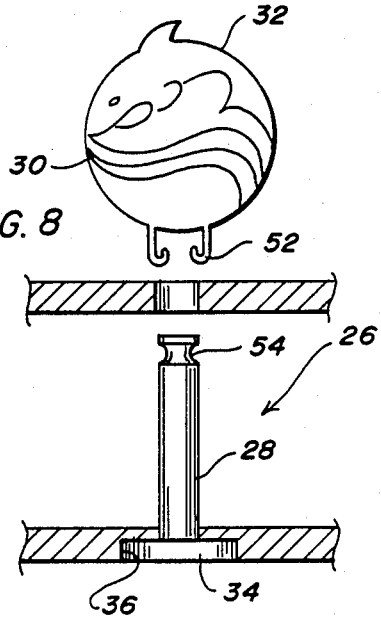
FIG. 8 shows yet another means for attaching the top of the toe tab.
Figure 9:
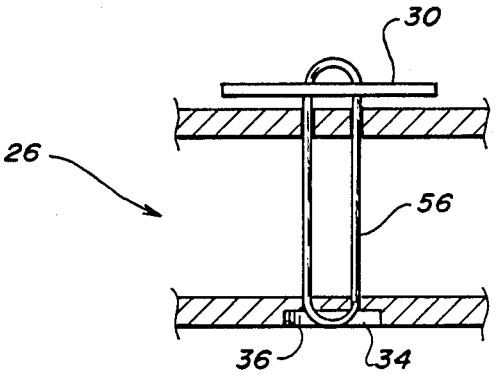
FIG. 9 shows further means for attaching the top of the toe tab.

Various means for attaching protuberance 30 to stem 28 are shown in FIGS. 5–9. In FIG. 5, stem 28 terminates in a ball 40 which is snapped into a correspondingly shaped socket 42 provided in protuberance 30. In FIG. 6, taken in combination with FIG. 6A, it is seen that the male member may be on protuberance 30, wherein stem 28 is shown with a hollow cavity 44 into which bayonet coupling 46 is received. FIG. 7 has protuberance 30 with threads 48 for attachment to corresponding threads 50 on stem 28. FIG. 8 shows protuberance 30 with clips 52 which are received in an indent 54 in stem 28. In FIG. 9, stem 28 is illustrated as a lace 56 passing though sole 12 and through protuberance 30.

When thong sandal 10 is worn, the foot of the wearer is placed upon sole 12, the big toe passes to one side of stem 28 while the other toes pass to the other side thereof. Instep strap 20 lies above the wearer's instep extending laterally above most of the area of the toe joints and then extending rearwardly on the lateral opposite sides of the foot. Toe tab 26 is releasably latched in slot 22 of instep strap 20 and is received in keyhole 24 which is provided therefore. Protuberance 30 rises above instep strap 20 and provides a highly visible surface which can be customized to the purchaser's requirements.

In view of the above, it will be seen that the several objects of the invention are achieved and other advantageous results attained. As various changes could be made in the above constructions without departing from the scope of the invention, it is intended that all matter contained in the above description or shows in the accompanying drawings shall be interpreted as illustrative and not in a limiting sense.

What is claimed:

1. A thong sandal having a sole with heel, toe and instep portions fastened to the foot of a wearer by means of an instep strap running over the instep of the wearer and a toe tab attached to the sole in a position on the sole between the wearer's first and second toes and latched in the instep strap, said sole and instep strap formed from a flat sheet of material which is flexible and provides a comfortable support when walking and of a size and shape to fit under the wearer's foot, said instep strap partially cut away form the sole around the heel and remaining attached to the sole on opposite sides of the instep of the sole and adapted to fold upward and forward and to latch on the toe tab, said toe tab formed of a durable material such that it does not break during normal wear and that it latch generally flat against the sole for storage or shipment in a latch provided at the toe end of the sole.

2. The thong sandal of claim 1 wherein the toe tab has a protuberance at its free end distal the sole which rides above the wearer's foot when the toe is latched in the instep strap, said protuberance providing a visible surface upon which advertising and decoration may be applied and means are provided on the toe tab for detachably mounting the protuberance.

3. The thong sandal of claim 2 wherein the protuberance snaps on the stem.

4. The thong sandal of claim 2 wherein the protuberance screws on the stem.

5. The thong sandal of claim 2 wherein the protuberance bayonet latches on the stem.

6. The thong sandal of claim 2, wherein the protuberance is clipped on the stem.

7. The thong sandal of claim 2 wherein the stem is formed of a lace and the protuberance is laced on the stem.

* * * * *